United States Patent [19]

Collins

[11] Patent Number: 4,558,540

[45] Date of Patent: Dec. 17, 1985

[54] KNIFE SHARPENER

[76] Inventor: Walter W. Collins, P.O. Box 158, North, S.C. 29117

[21] Appl. No.: 461,994

[22] Filed: Jan. 28, 1983

[51] Int. Cl.[4] ..... B24D 15/08

[52] U.S. Cl. ..... 51/214; 51/205 WG; 76/82; 76/88

[58] Field of Search ..... 51/211 R, 211 H, 212–214, 51/382, 370, 205 R, 205 WG, 204, 359, 391–393, 285; 76/82, 81.3, 84; 30/162

[56] References Cited

U.S. PATENT DOCUMENTS

| | | | |
|---|---|---|---|
| 651,462 | 6/1900 | Jones | 51/211 R |
| 882,137 | 3/1908 | Brandenburg | 51/211 H |
| 932,724 | 8/1909 | Smith | 51/391 |
| 1,738,496 | 12/1929 | Laux | 30/162 |
| 1,976,070 | 10/1934 | Hermann | 51/211 H |
| 2,284,168 | 5/1942 | Rickenbacher | 30/162 |
| 2,288,407 | 6/1942 | Lada | 51/181 |
| 2,308,624 | 1/1943 | Pouech | 51/211 R |
| 2,988,933 | 6/1961 | Buck | 76/84 |
| 3,719,461 | 3/1973 | Topping | 51/211 |
| 4,094,106 | 6/1978 | Harris | 51/214 |

*Primary Examiner*—Frederick R. Schmidt
*Assistant Examiner*—Robert A. Rose
*Attorney, Agent, or Firm*—Klarquist, Sparkman, Campbell, Leigh & Whinston

[57] ABSTRACT

A knife sharpener includes an elongated sharpening element held within a tray that selectively telescopes within one end of a handle to store the element. The handle has a forward surface that lies in an inclined plane and approaches the sharpening surface of the extended sharpening element at the correct angle for sharpening the cutting edge of a knife blade so as to provide a sharpening guide. The tray and handle provide a thumb-operated, bolt-action device for extending and retracting the tray and its sharpening element, for locking the tray in its extended and retracted positions, and for selectively releasing the tray from its locked positions. The sharpening element may be a block of ceramic abrasive material surfaced on one face with a diamond-studded cloth to provide a coarse abrasive sharpening surface and longitudinally grooved on an opposite face to provide a fine abrasive honing surface.

9 Claims, 7 Drawing Figures

FIG. 1
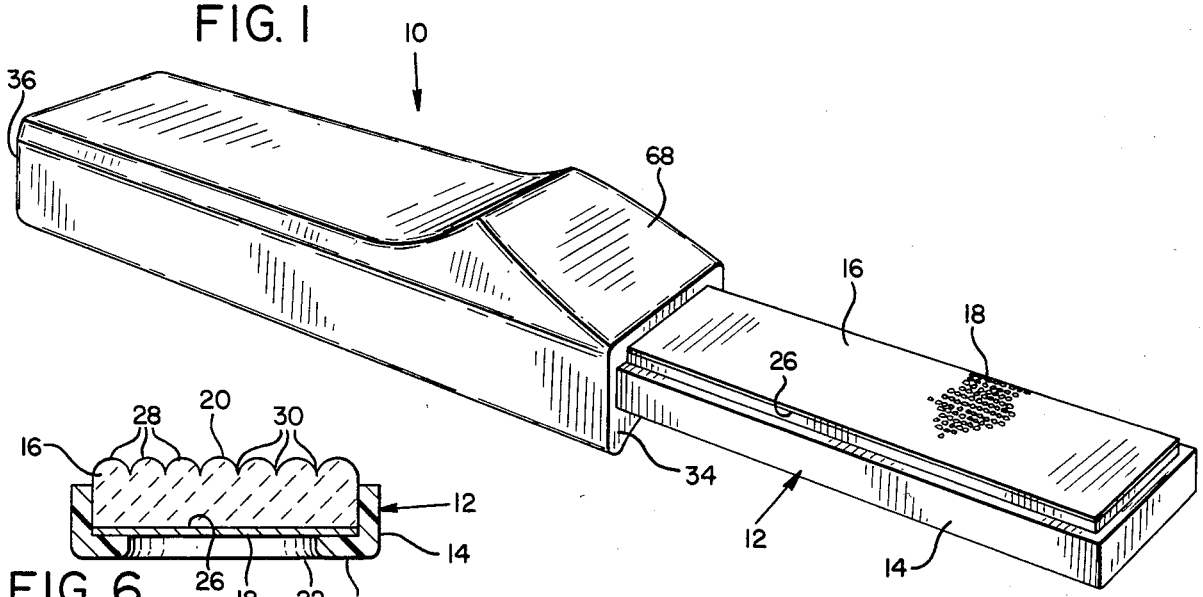
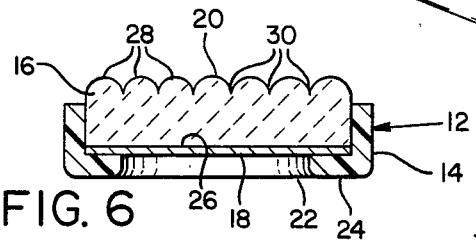
FIG. 6
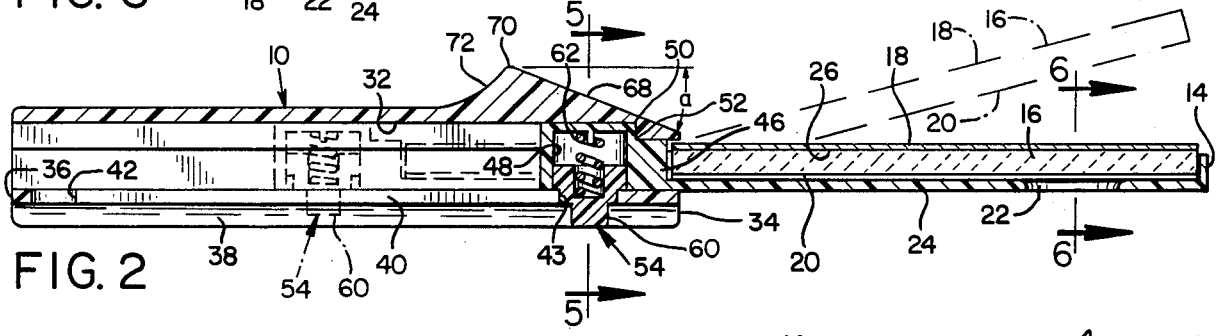
FIG. 2
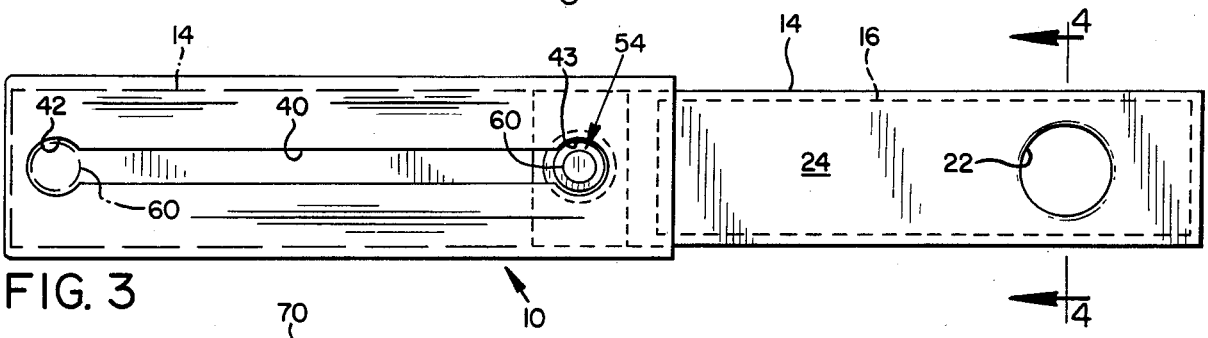
FIG. 3
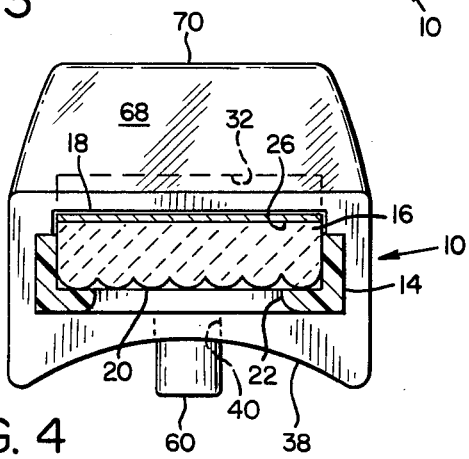
FIG. 4
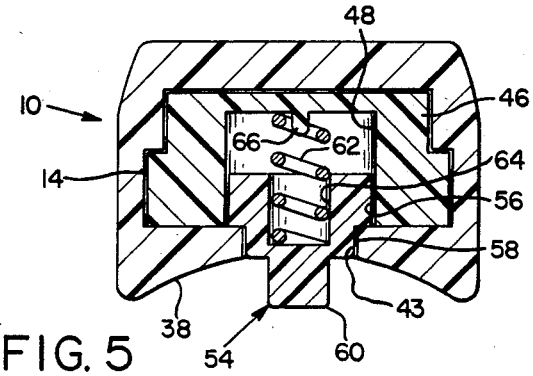
FIG. 5

KNIFE SHARPENER

FIELD OF THE INVENTION

The present invention relates to knife sharpeners, and especially to hand-held manual sharpeners utilizing a sharpening stone.

BACKGROUND OF THE INVENTION

Sharpening steels and stones have long been used to manually sharpen a knife blade. Various abrasives have been used as the sharpening elements in such steels and stones. Stones have been made in the form of ceramic blocks containing an abrasive composition such as aluminum oxide. Some sharpening stones or blocks have included a fine abrasive on one sharpening surface and a coarse abrasive on an opposed sharpening surface. Sharpening steels have been rigidly mounted to handles to facilitate holding the steel while sharpening a knife. In one form of known handle-mounted steel, a hollow handle is detachable from the steel, and the steel can be reversed and stored in the handle.

Despite the myriad of hand-held manual knife sharpeners that have been devised, none combines all of the attributes of being easy to hold while using, easy to use, and easy to carry when not in use. Nor do any of the known such sharpeners have, in addition to the above attributes any feature that promotes consistently accurate sharpening of a knife blade at the correct sharpening angle.

It is therefore a primary objective of the present invention to provide an improved hand-held, manul knife sharpener that combines all of the foregoing attributes.

More specifically, a prime objective of the invention is to provide an improved knife sharpener with a combination of features that renders it easy to hold, easy to use and easy to carry.

Another important object is to provide a knife sharpener as aforesaid with a built-in knife sharpening guide for sharpening the cutting edge of a knife blade at the correct sharpening angle.

Another object is to provide a knife sharpener as aforesaid which is comfortable to hold while using.

Another significant object is to provide a knife sharpener as aforesaid which provides for storage of the sharpening element in the handle of the sharpener without detaching the element from the handle.

Other important objects are to provide a knife sharpener as aforesaid which sharpens a knife faster, easier, more accurately, and better than prior manual knife sharpeners.

SUMMARY OF THE INVENTION

The present invention is a hand-held manual knife sharpener including a handle and attached sharpening means which telescopes into the handle for storage. The handle may be elongated and sized and shaped to fit comfortably within the palm of the hand with the sharpening means extending from one end of the handle. The sharpening means may include a tray and a sharpening element removably held within the tray. The tray may be connected to the handle for relative sliding movement between extended and retracted positions by thumb-operated, bolt-action means which includes means to lock the tray in such positions and thumb-operated means to selectively release the locking means to enable such movement.

The sharpening element may be a block of abrasive material having a coarse abrasive side and a fine abrasive side, with the block being reversible in the tray for selective use of either side. The block may be composed of a fine ceramic abrasive material having a longitudinally grooved sharpening surface on one side. The opposite side of the block may have a coarse abrasive sheet material bonded to it such as a commercially available diamond-studded cloth.

The handle may include a forward face disposed in an inclined plane adjacent a sharpening surface of the extended sharpening element, with the face being inclined at an angle such that it provides a sharpening guide for a knife blade laid against such surface.

The foregoing and other objects, features and advantages of the present invention will be more apparent from the following detailed description and the accompanying drawings referred to in the description.

BRIEF DESCRIPTION OF DRAWINGS

In the drawings:

FIG. 1 is a perspective view of a knife sharpener in accordance with the invention showing its sharpening means extended from its supporting handle;

FIG. 2 is a longitudinal sectional view taken along the line 2—2 of FIG. 1;

FIG. 3 is a bottom plan view of the sharpener of FIGS. 1 and 2;

FIG. 4 is a sectional view taken along the line 4—4 of FIG. 3;

FIG. 5 is a cross-sectional view taken along the line 5—5 of FIG. 2;

FIG. 6 is a cross-sectional view taken along the line 6—6 of FIG. 2 but with the sharpening block shown in a position reversed from that of FIGS. 1, 2 and 4; and FIG. 7 is a perspective view of the sharpening element portion of the sharpener of FIG. 1, but showing the reverse side of such element.

DETAILED DESCRIPTION OF A PREFERRED EMBODIMENT

Referring to the drawings, the knife sharpener includes a generally rectilinear, elongated casing defining a handle 10 with a sharpening means 12 extending from one end of the handle. The sharpening means includes an upwardly opening, generally rectilinear tray 14 which holds a sharpening element 16.

The sharpening element is a generally rectilinear block of abrasive ceramic material which fits snugly within the tray but is upwardly removable therefrom. The block is also sized to extend slightly above the side edges of the tray to expose its sharpening surfaces. A preferred ceramic material for the sharpening block is an aluminum oxide composition such as a ceramic sold under the trade name AlSiMag 614, by 3M Company, of St. Paul, Minn. Such product is composed of approximately 96 percent aluminum oxide and four percent silicon and magnesium.

Sharpening block 16 is reversible in tray 14 to expose either one of two opposed sharpening surfaces 18, 20. Reversal of the block is facilitated by a finger hole 22 in the bottom wall 24 of the tray near its forward end through which a thumb or finger can extend to push the block upwardly from the tray as shown by dashed lines in FIG. 2. The flat sharpening surface 18 of the block is composed of a coarse abrasive material, preferably a thin layer or sheet 26 of industrial diamond-studded cloth bonded to the ceramic block. Such a diamond embedded cloth is also available from 3M Company, and is of the type disclosed in U.S. Pat. No. 4,256,467.

The opposite sharpening surface 20 of sharpening block 16 is longitudinally grooved from one end to the other to define a series of parallel and regularly alternating rounded ridges 28 and intervening sharp grooves 30. Ceramic sharpening surface 20 provides a fine abrasive for touching up or honing the cutting edges of knife blades that are only slightly dulled, or for honing a keen edge on a knife blade after it has been sharpened to some degree on the coarse abrasive surface 18. It has been found that ridges 28 of such surface greatly facilitate the final honing operation.

Handle 10 includes a hollow interior defining a channel 32 extending through the handle from its forward end 34 to its rear end 36 for slidably receiving tray 14 and its sharpening block 16. Handle 10 also includes a concavely curved bottom wall 38 shown best in FIGS. 4 and 5. A longitudinally extending keyway groove 40 extends along the median line of such wall and terminates at opposite ends at enlarged keyholes 42, 43.

The inner end of the opening of tray 14 terminates at an upwardly enlarged plunger housing 46 which defines a downwardly opening cylindrical plunger chamber 48. Plunger housing portion 46 is relatively permanently contained within channel 32 of handle 10. A downwardly extending lip 50 at a forward end portion of channel 32 abuts an upwardly stepped shoulder portion 52 of plunger housing 46 to limit the forward sliding movement of tray 14 within channel 32 and thereby prevent the forward removal of the tray from the handle. Thus, step 52 and lip 50 determine the extended sharpening position of the sharpening means, including tray 14 and sharpening block 16.

From the foregoing it will be apparent that the tray and its sharpening block may be telescoped from their extended positions shown in FIGS. 1–3 to fully retracted positions within handle 10, shown in phantom lines in FIG. 3. The overall length of tray 14 is substantially the same as the overall length of handle 10 so that in the retracted position of the tray, its opposite ends are substantially flush with the opposite ends of the handle.

Manually operable means are provided for sliding the tray and its contained sharpening block between their extended and retracted positions and for automatically locking the tray in both positions. Such manually operable means also includes means for selectively releasing the tray from either of its locked positions to enable its movement between extended and retracted positions. Such means include, in addition to the keyway slot 40 and enlarged keyhole end portions 42, 43 of the handle, a plunger 54 within plunger chamber 48 of the tray, shown best in FIG. 5. The plunger includes a cylindrical piston portion 56 adapted to slide along the interior walls of plunger chamber 48, a cylindrical locking portion 58 of a diameter slightly less than that of piston portion 56, and a push button portion 60 of smaller diameter than locking portion 58. Plunger 54 is biased outwardly of the handle away from the bottom of chamber 48 by an internal compression spring 62 seated within an axial bottom opening 64 of the plunger. A small center projection 66 from the inner bottom wall of plunger chamber 48 centers the spring within such chamber.

The diameter of push button 60 is less than the width of keyway slot 40 so that the button always projects outwardly beyond such slot and keyholes 42, 43. However, the diameter of locking portion 58 of the plunger is greater than the width of slot 40, but less than the diameter of the keyholes. Therefore, when button 60 is depressed against spring pressure and forced either forwardly or rearwardly along slot 40, the shoulder of locking portion 58 rides on the inside bottom surface of handle channel 32, enabling the tray and sharpening block to move between their extended and retracted positions. However, as soon as the pushbutton is pushed into either forward keyhole 43 or rear keyhole 42, compression spring 62 pushes locking portion 58 of the plunger outwardly into the keyhole to lock the tray against further movement. To release the tray from its locked position, pushbutton 60 is depressed to push locking portion 58 from the keyhole and pushed forwardly or rearwardly away from the keyhole until locking portion 58 clears the keyhole and again rides along the inside bottom wall of the handle channel 32. This action enables easy movement of the tray relative to the handle by pushing button 60 along keyway 40.

From the foregoing it will be apparent that the spring-biased plunger, in conjunction with the keyway and keyholes of the handle, provides the knife sharpener of the invention with a manually-operated bolt action means for easily extending and retracting the sharpening element, locking it in an extended or retracted position, and selectively releasing it from its locked positions, all with the handle held in the palm of one hand using only the thumb of that hand to manipulate the push button 60.

Referring to FIGS. 1 and 2, the top of handle 10 includes an inclined, flat, forward surface 68 which slopes upwardly and rearwardly from its forward end 34 to a laterally extending ridge 70 at an intersection with an upwardly and forwardly sloping top surface 72 of the handle. Surface 72, which is slightly concave, defines a thumb rest when gripping the handle during a sharpening operation. Surface 68 is an inclined plane which forms an acute angle a with an adjacent sharpening surface 18 of the extended sharpening block. Angle a, which is preferably about 20°, is selected so that when the flat of a knife blade is laid along inclined plane face 68 with the cutting edge directed toward sharpening surfaces 18, 20, the bade is at the correct angle for sharpening its cutting edge. Inclined plane face 68 thus serves as a sharpening guide for holding the knife blade at the correct angle for sharpening with respect to the sharpening surface.

Handle 10, tray 14 and plunger 54 can advantageously be molded of any suitable plastic material. In one example of the knife sharpener, the major dimensions of the handle are: overall length—4.375 inches; maximum height to ridge 70—1.021 inches; minimum height—0.740 inch, and overall width—1.200 inches. In the same example, the major dimensions of the tray are: length—4.375 inches; width—1.020 inches; overall height of the tray portion—0.360 inch; maximum height at the plunger housing—0.444 inch; depth of the tray opening—0.160 inch; and length of the tray portion—3.510 inches. In the same example, the plunger has the following dimensions: overall maximum diameter at the piston portion—0.468 inch; diameter at the locking portion—0.368 inch; diameter at the button portion—0.244 inch; overall length—0.415 inch; button length—0.110 inch; length of piston portion—0.225 inch; and shoulder length—0.080 inch. On the handle, the length of keyway slot 40 to the center of the opposite keyholes is 3.438 inches; the width of the slot is 0.250 inch; and the diameter of the keyholes is 0.375 inch. The other features of the same knife sharpener are dimensioned proportionately.

OPERATION AND USE

Normally, the knife sharpener of the invention is carried in the pocket or otherwise with tray 14 and its sharpening element 16 retracted into handle 10. In such position, button 60 protrudes from rear keyhole 42. To extend the tray and its sharpening element, the handle is conveniently held upside-down in one hande. The thumb of that hand depresses button 60 to release locking shoulder 58 and then pushes forwardly along keyway slot 40 to slide tray 14 and its sharpening block forwardly from the forward end of the handle. When the thumb pushes the button into forward keyhole 43, spring 62 urges plunger 54 upwardly, causing its locking portion 58 to engage the wall of keyhole 43 to lock the tray and sharpening block in their extended positions.

To sharpen a dull knife, first the diamond-studded side 18 of sharpening block 16 is exposed in the tray. The handle is held right-side-up in the palm of one hand, with the thumb of that hand resting on the curved top surface portion 72 of the handle. With the opposite hand, the flat of a knife blade is laid along inclined surface 68 of the handle, with its cutting edge directed toward sharpening surface 18 to determine the correct sharpening angle for the blade. Maintaining this angle, the blade is stroked forwardly and across diamond surface 18 of the sharpening block several times. After each stroke, the blade is returned briefly to inclined guide surface 68 to make certain that the correct blade angle is maintained at the start of each sharpening stroke.

Then the opposite side of the blade is laid along guide surface 68 of the handle, again with the knife edge directed toward the sharpening surface. The cutting edge is again drawn forwardly along and across the sharpening surface several times with the blade at an angle to the sharpening surface dictated by the guide surface. After several sharpening strokes with both sides of the blade, its cutting edge should be reasonably sharp.

In sharpening one side of the knife blade, the user will be drawing the blade across the sharpening surface away from the user. However, in sharpening the opposite side of the blade, it might be most convenient to turn the handle around so that the sharpening block and tray are directed toward the user, requiring that the blade be drawn generally toward the user in stroking it across the sharpening block. Alternatively, the handle can be turned upside-down to stroke the opposite side of the blade. However, no change of handle position is required in stroking the opposite side of the blade if guide surface 68 is not used.

When the cutting edge of the blade has been fairly well sharpened on coarse surface 18 of the sharpening block, the block is removed from its tray and reversed top-to-bottom to expose the opposite, ceramic sharpening surface 20 for fine honing the cutting edge. To do this, the sharpening strokes previously described are repeated as before, using guide surface 68 to correctly position the blade for sharpening.

When the knife edge is honed to the desired sharpness, the user turns the handle over in the palm of the hand, depresses button 60, and pushes it rearwardly with the thumb along keyway slot 40 to retract the tray and sharpening block into the handle. When the button reaches rear keyhole 42, spring 62 again forces plunger 54 outwardly to snap locking portion 58 into its locking position within the keyhole to lock the tray and its sharpening element in their retracted positions. Thereafter, the sharpener can again be slipped in the pocket or otherwise conveniently carried until again needed for sharpening.

Having illustrated and described the principles of my invention by what is presently a preferred embodiment thereof, it should be apparent to persons skilled in the art that the invention may be modified in arrangement and detail without departing from such principles. Therefore, I claim as my invention all such modifications as come within the true spirit and scope of the following claims.

I claim:

1. A portable hand-held knife sharpener comprising:

a casing defining a handle, a tray slidably mounted in said casing for telescoping movement between a retracted position in which said tray is housed within said casing and an extended position in which said tray extends from an open end of said casing, said tray including a tray recess defined by tray sidewalls, a sharpening block removably mounted within said tray recess and extending upwardly above said tray sidewalls for use in sharpening a knife blade while remaining in the tray, said block including an exposed sharpening surface, said casing encompassing the tray and block throughout substantially the full length of said tray in said retracted position to retain said block in said tray, releasable bolt-action means cooperable with said tray and casing for extending and retracting said tray and block relative to said casing, said bolt-action means being operable in said retracted position to lock said tray within said casing, said bolt-action means being cooperable with said tray and casing in said extended position to lock said tray in said extended position, said tray including a tray end extension extending rearwardly of said tray recess, said bolt-action means including a plunger chamber within said tray end extension and spring-biased plunger means extending through a slot in a wall of said casing and into said chamber for selectively locking said tray in and releasing said tray from said extended and retracted positions, said casing including an elevated upper front end portion including an inclined planar surface sloping downward nd forward toward said sharpening surface at an angle to said sharpening surface when said tray is extended such that said inclined surface provides a sharpening guide for positioning said blade at a desired sharpening angle with respect to said sharpening surface.

2. A sharpener according to claim 1 wherein said casing, block and tray are rectilinear in shape, with their respective widths being greater than their respective thicknesses.

3. A device according to claim 1 wherein said block includes a sharpening surface lying in a first plane and said inclined surface lies in a second plane which intersects said first plane in a straight line.

4. A device according to claim 3 wherein said inclined surface is inclined upwardly in a direction away from said one end and intersects a second surface of said handle sloping upwardly in a direction toward said one end such that said second surface defines a thumb rest when gripping said handle.

5. A device according to claim 1 wherein said tray means includes release means for facilitating removal of said block from said tray means.

6. A device according to claim 5 wherein said release means includes a finger opening through a bottom surface of said tray means adjacent the free end thereof.

7. A device according to claim 1 wherein said sharpening surface comprises a series of regular alternating longitudinally extending ridges and grooves extending the lengthwise of said block.

8. A device according to claim 1 wherein said block includes two opposed and reversible sharpening surfaces, one said sharpening surface being more abrasive than the other.

9. A device according to claim 1 wherein said block includes two opposed and reversible sharpening surfaces, one sharpening surface comprising an abrasive ceramic composition, the other sharpening surface comprising a diamond studded surface.

* * * * *